United States Patent [19]

Seifert

[11] 4,105,543

[45] * Aug. 8, 1978

[54] METHOD FOR SCREENING PAPER FIBER STOCK

[75] Inventor: Peter Seifert, Middletown, Ohio

[73] Assignee: The Black Clawson Company, Middletown, Ohio

[ * ] Notice: The portion of the term of this patent subsequent to Nov. 19, 1991, has been disclaimed.

[21] Appl. No.: 686,490

[22] Filed: May 14, 1976

Related U.S. Application Data

[63] Continuation of Ser. No. 496,160, Aug. 9, 1974, abandoned, which is a continuation of Ser. No. 288,293, Sep. 12, 1972, abandoned.

[51] Int. Cl.[2] ..... B07B 1/20

[52] U.S. Cl. ..... 209/240; 209/273; 209/379

[58] Field of Search ..... 209/304, 306, 273, 300; 210/415

[56] References Cited

U.S. PATENT DOCUMENTS

| | | | |
|---|---|---|---|
| 1,856,176 | 5/1932 | Trimbey | 209/273 |
| 2,900,077 | 8/1959 | Sandison | 209/273 X |
| 2,975,899 | 3/1961 | Cannon | 209/273 |
| 2,983,379 | 5/1961 | Cram | 209/273 |
| 3,080,696 | 8/1972 | Morin | 209/273 |
| 3,363,759 | 11/1968 | Clarke-Powder | 209/273 |
| 3,394,809 | 7/1968 | Hunter | 209/306 X |
| 3,581,893 | 6/1971 | Rich | 210/415 X |
| 3,581,903 | 6/1971 | Holz | 210/415 |
| 3,586,172 | 6/1971 | Hunter | 209/273 |
| 3,726,401 | 4/1973 | Bolton | 209/273 |
| 3,849,302 | 11/1974 | Seifert | 209/306 X |

FOREIGN PATENT DOCUMENTS

| | | | |
|---|---|---|---|
| 203,353 | 5/1959 | Austria | 209/304 |
| 727,010 | 2/1966 | Canada | 162/4 |
| 735,273 | 5/1966 | Canada | 209/273 |

*Primary Examiner*—Robert Halper
*Attorney, Agent, or Firm*—Biebel, French & Nauman

[57] ABSTRACT

A method of screening paper fiber stock incorporating a screen member having generally circular perforations and a rotor supporting vanes movable in the supply chamber, the rotor vanes are spaced from the screen member by a substantial distance (3/16–½inch) to establish a tubular layer of stock of corresponding radial thickness adjacent the screen member, the rotor is operated at high speed to develop strong hydraulic shear forces in the tubular layer of stock causing tangential orientation of predominantly two-dimensional contaminant particles, and ribs on the inlet side of the screen member cause the stock to be continuously recirculated in the supply chamber to prevent undue increase in the consistency of the stock in the tubular layer, thereby enabling the screen to operate effectively at high capacity and high stock consistencies.

3 Claims, 1 Drawing Figure

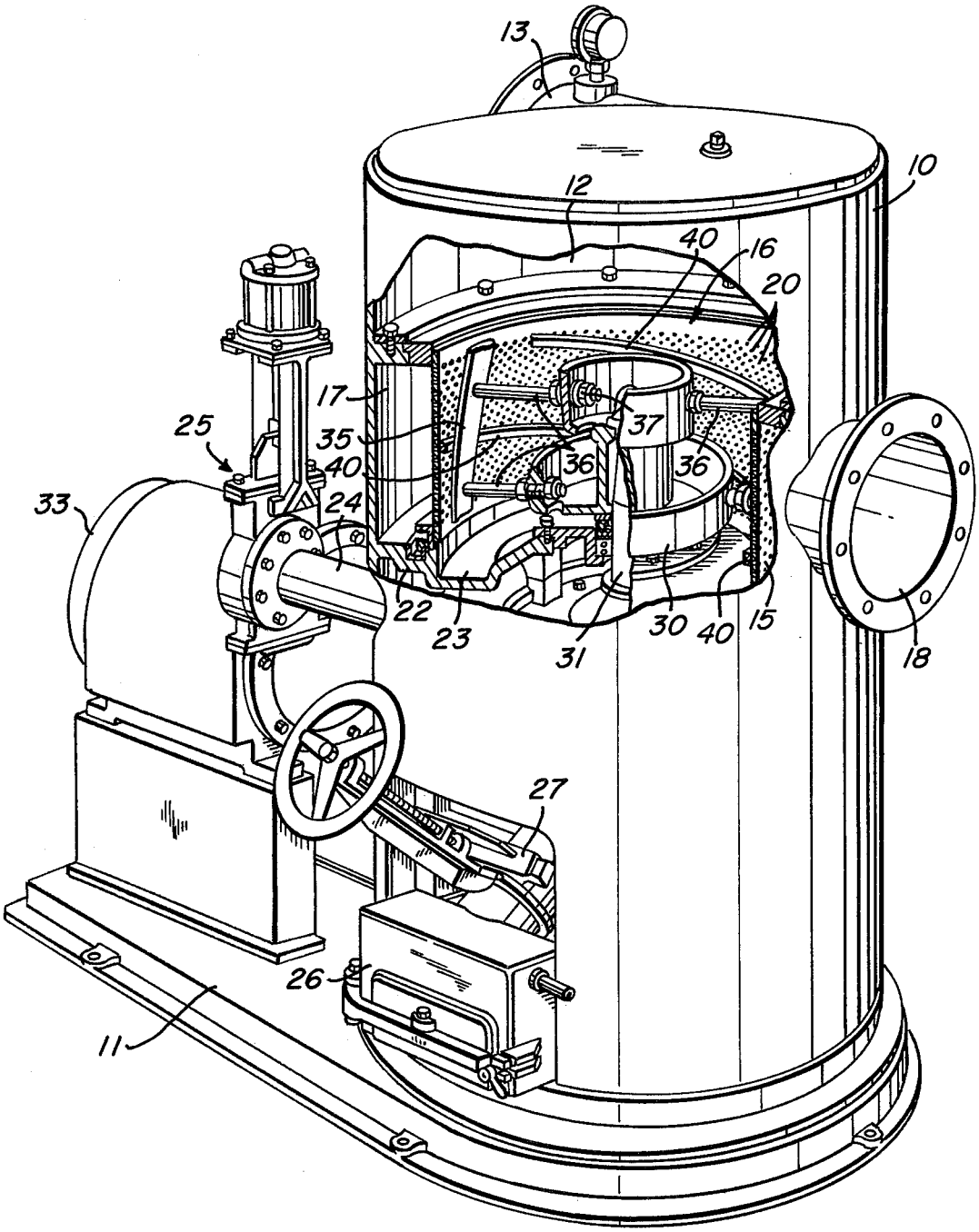
13
10
12
40
16
20
17
25
35
37
40
36
36
33
24
22
23
31
30
40
15
18
27
26
11

METHOD FOR SCREENING PAPER FIBER STOCK

RELATED APPLICATION

This application is a continuation of application Ser. No. 496,160, now abandoned filed Aug. 9, 1974 as a continuation of Ser. No. 288,293, now abandoned filed Sept. 12, 1972.

BACKGROUND OF THE INVENTION

Paper mills have for many years made extensive use, for the screening of paper making stock, of screen apparatus embodying a cylindrical perforate screen member defining supply and accepts chambers on the opposite sides thereof in a closed housing and provided with a rotor member which operates in one of the chambers to keep the screen perforations open and free from solid material tending to cling to the screen surface. Commonly, the stock or furnish is delivered to the supply chamber adjacent the end of the screen member, and the material rejected by the screen member is collected and discharged from the opposite end of the screen member.

The assignee of this invention has manufactured and sold many such screens, originally in accordance with Staege U.S. Pat. No. 2,347,716, and more recently in accordance with Martindale U.S. Pat. No. 2,835,173, the latter construction being characterized by a rotor comprising bars or vanes of air-foil section in closely spaced but non-contacting relation with the surface of the screen member. More specifically, these vanes have been moved along the screening surface at relatively low speeds, e.g. in the range of 1,250–2,500 feet per minute, with the clearance between the supply side of the screen member and the nearest portion of the vanes being in the range of 0.030–0.060 inch.

The art has experimented widely with detailed variations in screens of the above type, including variations in the vane shape and other forms of rotor, and also in the size, spacing and configuration of the perforations in the screen member. In recent years, such screens have been offered to the trade wherein the rotor is a wall member provided with multiple bumps or other offset portions over its surface for the purpose of creating localized changes in volume, and resulting agitation effects, in the annular space between the rotor and the screen member, a typical such construction being shown in Clarke-Pounder U.S. Pat. No. 3,363,759.

SUMMARY OF THE INVENTION

The present invention is directed to the provision of a screen of the type outlined above wherein the screen member has multiple generally circular perforations and which will offer important practical advantages over the previously available similar screens, particularly in the following respects:

a. High throughput rate per unit area of screen cylinder surface, e.g. as high as 40 tons per day per square foot;
b. high feed consistencies, e.g. as high as 5%;
c. relative insensitivity to fluctuations of feed consistency, furnish type and/or flow rate;
d. the ability to screen out the predominantly two-dimensional types of contaminant particles, e.g. slivers and flakes, otherwise capable of passing through the perforations;

e. effective screening action over the entire perforate area of the screen member, with minimum tendency to undesirable thickening of the furnish adjacent the end of the screen member nearest to the reject outlet;
f. economy of maintenance and operation, especially from the standpoint of the power requirements with relation to throughput; and
g. mechanical reliability, especially from the standpoint of minimum damage to working parts.

In general it appears immaterial to the practice of the invention whether the supply chamber be on the inside or outside of the screen member, but it is essential that the rotor include bars or vanes which are located on the supply side of the screen member. It is also essential to this invention that the speed of the rotor be substantially increased as compared with conventional practice, to establish a correspondingly high peripheral speed for the vanes. For example, and in contrast to the range of approximately 1,250–2,200 feet per minute prescribed in the Martindale patent, outstanding results in the practice of the invention have been obtained with the vanes traveling at speeds of the order of 5,000 feet per minute. This is a practical limit for economic reasons although in principle, considerably higher speeds (e.g. 12,000 rpm) can be used and will permit operation at correspondingly higher consistencies and throughput rates.

Another particularly important characteristic of the invention is that the rotor vanes should be spaced substantially further from the adjacent surface of the screen member than in the prior practice. To illustrate, in contrast with the range of 0.030–0.060 inch specified in the Martindale patent, optimum results have been obtained in the practice of the invention with this spacing in the range of 3/16 to ½ inch, and in contrast with the range of 0.5–1.0% consistencies conventionally used with screens constructed in accordance with the Martindale patent, the invention makes it possible to handle feed consistencies as high as 5% solids. In general, optimum results from the standpoint of screening effectiveness with high consistencies and throughput rates have been obtained with the maximum rotor speed and vane spacings noted herein. Decreased vane to screen spacings can be used successfully at lower vane speeds, with corresponding reduction in capacity and throughput while still obtaining effective screening.

Under these dimensional and operational conditions, several important results are accomplished. The first is to establish an annular layer of furnish immediately adjacent the supply side of the screen member which is of substantial thickness, corresponding to the spacing between the rotor vanes and the screen member. Movement of fiber through the screen perforations will take place from this layer, but due to a number of factors, including particularly the frictional resistance of the edges of the holes to the passage of fiber therethrough, water will flow through the holes faster than the fibers, and since this water will be replaced by furnish at the feed consistency, the layer will be generally of a higher consistency than the balance of the furnish in the supply chamber. This increase in consistency will of course also be contributed to by the presence of reject particles in the annular layer.

A particularly significant result of the conditions outlined above is the creation of a substantially tangentially oriented steady field of hydraulic shear in the tubular layer of furnish between the path of the rotor vanes and the inlet side of the slotted screen member.

Thus, that portion of this tubular layer contiguous to the surface of the screen member will have a circumferential velocity which approaches zero, because substantial portions thereof will pass through the slots, and their velocity will be essentially radial. Additionally, this layer will be subject to skin friction with respect to the imperforate surface portions of the screen member. On the other hand, the portion of the layer nearest to the vane path will travel circumferentially at a high velocity, approaching that of the vanes themselves. The intermediate portion will therefore travel at this velocity, varying from a maximum near the vane path to a minimum near the relatively zero velocity portion next to the screen member.

The importance of the shear forces created as just described derives from the effect which they have on the predominantly two-dimensional contaminant particles in the furnish, namely the slivers and flakes. These particles are induced to align themselves generally tangentially of the screen surface. The tangential alignment of such elongated particles will cause them to travel past the holes and to remain on the reject side of the screen member, whereas if they were randomly oriented, many would pass through the holes.

It is important to the practice of the invention to assure minimum disturbance of the shear field in the tubular layer of stock between the vane path and the screen member. Thus contrary to the principle of localized agitation effects emphasized in the Clarke-Pounder patent, optimum results are obtained if the vanes are smooth and extend the full axial length of the screen member to produce a uniform wave action instead of localized turbulance such as would result from the ends of shorter vanes. Similarly, the surface of the inlet side of the screen member should be smooth and free of flow-disrupting protrusions.

A further desirable result provided by this invention can best be explained by noting first that in the conventional practice according to the Martindale patent, with the rotor vanes moving in closely spaced relation to the surface of the screen member, the pressure pulse between the leading edge of each vane and the adjacent surface of the screen member tends to create excessive flow through the perforations, which can result in an undesirable extent of dewatering of the fiber in that immediate vicinity and mechanical smearing of the fiber over the screening surface. The large increase in the spacing of the vanes from the screen surface in accordance with the invention eliminates these undesirable effects, but at the same time, the high speed for the vanes prescribed by the invention creates a sufficient suction pulse between the trailing end of each vane and the screen member to keep the screen surface clean.

In connection with the point just discussed, it is pertinent that in screens of this general type wherein rotor vanes operate in closely spaced relation to the screen member, as in the Martindale patent, there is a tendency for the screen member to fracture, apparently because of the pressure pulses produced by the traveling vanes. It would seem likely that at the substantially higher rotor speeds prescribed by this invention, increased screen breakage problems could result, but the contrary has ocurred, apparently because the substantial increase in spacing between the vanes and the screen member significantly reduces the intensity of the pulses on the screen member.

It is essential that provision be made for progressively eliminating reject particles from the annular layer of furnish adjacent the screen member, since they would otherwise tend to cause continuing increase in the consistency of this layer. In particular, with the discharge outlet for reject material at the opposite end of the chamber from the feed inlet port, the concentration of reject particles along the portion of the screen member nearest the discharge outlet can increase the consistency of the slurry in that area to such extent that passage of fiber therefrom through the screening holes becomes minimal. This problem is solved in accordance with the invention by causing the furnish to recirculate generally axially of the screen member from the portion of the annular layer nearest the discharge end of the supply chamber back in the opposite direction through the interior of the chamber to the inlet end of the chamber.

One means by which recirculation is effected as just described is by the use of rotor vanes which are generally helically curved as shown in the Martindale patent. In that patent, this vane configuration is relied upon to cause reject particles to migrate by reason of the suction effect created along the trailing edge of each vane, and this result does occur with the vanes spaced closely from the scren member. With the vanes spaced farther away from the screen member in accordance with the invention, however, the primary force causing migration of reject particles toward the discharge end of the chamber is the downward component given to the annular layer of the stock as a whole by reason of the high speed of the forwardly tilted vanes.

Preferred means for effecting the desired recirculation, with which optimum results have been obtained in the practice of the invention, are provided by one or more helically curved ribs mounted on the inlet side of the screen member and of substantial radial thickness, preferably just enough less than the spacing between the screen member and the rotor vanes for running clearance of the vanes. For example, highly satisfactory results have been obtained with two such ribs each having a radial clearance of ¼ inch where there is a space of 5/16 inch between the screen member and the vanes. Such ribs will have the effect of channeling the furnish in the tubular layer immediately adjacent the screen member so that it is forced to flow both circumferentially and axially of the screen member and thereby to recirculate within the supply chamber at a relatively rapid rate, depending upon the speed of the rotor. Further, and in order to minimize disruption of the shear field in the tubular layer, the helix angle of the ribs should be relatively small, preferred results having been obtained with the angle in the range of approximately 10° to 20°.

BRIEF DESCRIPTION OF THE DRAWING

The drawing is a perspective view, partly broken away, of screening apparatus embodying the invention.

DESCRIPTION OF THE PREFERRED EMBODIMENT

The screening apparatus shown in the drawing is constructed generally in accordance with the Martindale patent, with certain exceptions in accordance with the invention. It comprises a main housing 10 on a base 11, and in the upper end of the housing is an inlet chamber 12 having a tangential inlet port 13 to which the furnish is supplied under pressure, as is customary with such screening apparatus and in clockwise direction as viewed from above. A cylindrical screen member 15 divides the interior of the housing below chamber 12 into a central supply chamber 16 and an accepts chamber 17 having an outlet port 18. The screen member 15 is provided with multiple perforations 20 which may be of conventional size and spacing, typical dimensions being a hole diameter of 0.062 inches with a sufficient number of holes to provide an open area in the range of 10–15%.

The bottom wall 22 of the supply chamber 16 includes a trough 23 leading to a discharge port 24 provided with a control valve assembly 25 which can be preset to provide a desired continual bleed of reject-rich stock. Heavy particles which settle into the trough 23 drop therefrom to the heavy trash collection box 26 by way of manually controlled valve 27. The liquid flow from port 24 is commonly subjected to further screening after dilution, or it may in part be recirculated to inlet port 13 as described above.

A rotor 30 is supported on a drive shaft 31 in the center of the supply chamber 16 and is driven through suitable gearing or belts by a motor 33 also mounted on the base 11. Vanes or bars 35, shown as of the same configuration as in the Martindale patent, are mounted on the rotor 30 by support rods 36. Adjustable connections 37 between the inner ends of rods 36 and rotor 30 provide for positioning the vanes 35 in properly spaced relation with the inner surface of screen member 15, a space in the range of 3/16 to ½ inch being preferred, depending upon the vane speed, for the reasons already explained. The vanes 35 extend the full length of the screening surface of screen member 15, and they are helically curved and so arranged that the upper end of each vane is spaced forwardly of the lower end in the direction of rotation of the rotor, shown as clockwise.

On the inner surface of screen member 15 are ribs 40 each of such length and helical curvature that it extends from one end of member 15 to the other. As noted above, the radial thickness of each of these ribs should preferably almost equal the thickness of the tubular layer of furnish between the surface of screen member and the vanes 35. At the preferred speed and spacing of the vanes of 5,000 feet per minute and 5/16 inch, optimum results have been obtained with each rib of rectangular section which is ¼ inch in radial thickness and ½ inch wide. With these dimensions, there is minimum tendency for the vanes and ribs to have relative shearing action or for the ribs to disrupt the flow in the layer of stock along the surface of member 15, but the ribs will channel this stock so that it recirculates along a generally helical path within the supply chamber. This result is aided if the helix angle of the ribs is such that they are approximately normal to the forwardly tilted vanes 35.

Operating conditions for a screen as described in connection with the drawing should be controlled in accordance with the explanation under the "Summary of the Invention" heading. For a screen wherein the screen member 15 is 24 inches in diameter, optimum results from the standpoint of capacity have been obtained with the rotor operating at 800 rpm, which results in a vane speed of about 5,000 feet per minute, but for increased economy of operation, with respect to power requirements, good results can be obtained at lower speeds, with the lowest practical rate for the rotor being preferably not less than 500 rpm, giving a vane speed of about 3,000 feet per minute. Higher capacity with excellent results can be obtained with higher speeds, up to 2,000 rpm or about 12,000 feet per minute, which also makes it practical to handle stock at higher consistencies, up to 5%.

In summary, the examples noted above establish that for a vane spacing range of 3/16 to ½ inch, optimum results at a spacing of 5/16 inch are obtained at a vane speed of substantially 5,000 feet per minute, and that for lower speeds, down to the lowest practical rate of 3,000 feet per minute, the vane spacing should be correspondingly reduced. Similarly, the vane spacings in the upper portions of their range are used at vane speeds in the upper portion of the speed range from 5,000 to 12,000 feet per minute, and the consistency of the feed stock can similarly be varied to its maximum of the order of 5% at maximum vane speed and spacing.

While the method and form of apparatus herein described constitutes a preferred embodiment of the invention, it is to be understood that the invention is not limited to this precise method and form of apparatus, and that changes may be made therein without departing from the scope of the invention.

What is claimed is:

1. The method of screening a dilute suspension of paper fiber stock in a screen comprising a supply chamber having as one wall thereof a cylindrical screen member having multiple substantially circular perforations therethrough, a rotor mounted for rotation coaxially with said screen member, and a plurality of vanes carried by said rotor in said supply chamber in angularly spaced relation with each other, said method comprising the steps of (a) establishing said vanes at a predetermined uniform spacing from said screen member in the range of 3/16 to ½ inch so that upon rotation of said rotor with said chamber filled with stock, said vanes will cause the stock to form a tubular layer immediately adjacent said screen member which is of a thickness equal to said predetermined spacing, (b) continuously supplying feed stock to one end of said supply chamber at a rate sufficient to maintain said chamber full, (c) maintaining a pressure difference from said supply chamber to the accepts side of said screen member to cause passage of accepted stock through said perforations, (d) continuously driving said rotor to move said vanes at a sufficiently high speed to create a substantially tangentially oriented steady hydraulic shear field in said tubular layer of stock with shear rates sufficiently high to cause elongated contaminant particles to be aligned generally tangentially of said screen member and thereby to flow past rather than through said perforations, (e) controlling the speed of said rotor to cause said vanes to travel at a predetermined speed in the range of substantially 3,000 to 12,000 feet per minute which has substantially the same relative position in said speed range as the relative position of the thickness of said tubular layer in said thickness range of 3/16 to ½ inch, (f) maintaining the consistency of said feed stock in substantially the same relative position in a range of 0.5–5.0% solids as the relative position of the thickness of said tubular layer in said thickness range, (g) continuously removing from the other end of said supply chamber a portion of said stock including such contaminant particles, and (h) continuously recirculating stock from said other end of said supply chamber to said one end thereof.

2. The method defined in claim 1 wherein said recirculating step is effected by channeling the stock in said tubular layer along a spiral path from said one end of said supply chamber to said other end thereof.

3. The method defined in claim 1 wherein the stock is supplied to said supply chamber tangentially of said screen member and in the same direction of rotation as said vane means.

* * * * *